United States Patent [19]

Kaneko et al.

[11] 4,084,508

[45] Apr. 18, 1978

[54] OFFSET PRINTING MACHINE COMPRISING IMPROVED CONTROL MECHANISM

[75] Inventors: Tamaki Kaneko; Tugio Okuzawa, both of Tokyo, Japan

[73] Assignee: Ricoh Company, Ltd., Tokyo, Japan

[21] Appl. No.: 715,022

[22] Filed: Aug. 17, 1976

[30] Foreign Application Priority Data

Aug. 18, 1975 Japan ..... 50-99932

[51] Int. Cl.[2] ..... B41F 7/06

[52] U.S. Cl. ..... 101/142; 101/144; 101/232

[58] Field of Search ..... 101/147, 148, 141, 142, 101/144, 145, 230, 232

[56] References Cited

U.S. PATENT DOCUMENTS

| | | | |
|---|---|---|---|
| 3,426,678 | 2/1969 | Carper et al. | 101/141 |
| 3,521,560 | 7/1970 | Schmidlin et al. | 101/145 |
| 3,702,586 | 11/1972 | Kaneko et al. | 101/142 |
| 3,742,244 | 6/1973 | Raible | 101/142 |
| 3,749,009 | 7/1973 | Suzuki | 101/122 |
| 3,771,446 | 11/1973 | Kaneko et al. | 101/144 |

*Primary Examiner*—Edgar S. Burr
*Assistant Examiner*—William Pieprz
*Attorney, Agent, or Firm*—Frank J. Jordan

[57] ABSTRACT

A mechanism actuates a sheet feed means after a predetermined length of time after a control lever is moved to a print position, thereby allowing sufficient ink to be transferred to a transfer roller such that the first sheet printed has the same density as subsequent sheets. The mechanism comprises a ratchet and a pawl, the pawl being reciprocatingly driven in synchronism with the transfer roller and advancing the ratchet from a reset position to a position in which it engages with a sheet feed control linkage to activate the sheet feed means in a predetermined number of reciprocations corresponding to the predetermined length of time.

8 Claims, 5 Drawing Figures

OFFSET PRINTING MACHINE COMPRISING IMPROVED CONTROL MECHANISM

BACKGROUND OF THE INVENTION

The present invention relates to an improved control mechanism for an offset printing machine which causes a first sheet printed to have the same density as subsequent sheets.

In a well known offset printing machine, ink is applied to a cylindrical plate carrying a printing image and a transfer roller picks up the ink image from the plate and transfers the same to sheets, thereby effecting printing. A problem exists in the initial stage of operation of this type of printing machine in that it takes a certain amount of time to build up enough ink on the plate and transfer roller that the printed image on the sheets is of sufficient density. There is a certain amount of time after initiating the application of ink in which the ink buildup in optimum for printing. If the first sheet is fed to the transfer roller at exactly this time, the first sheet and all subsequent sheets will be printed with optimum density.

However, if the first sheet is fed at the same time the inking operation is started, the printing density of the first sheet or two will be too low, thereby wasting at least one sheet and requiring a further process step of removing the first sheet from the rest for disposal. Offset printing machines to date do not comprise an automatic means for feeding the first sheet at the correct time after inking begins.

SUMMARY OF THE INVENTION

It is an object of the present invention to provide an offset printing machine comprising an improved mechanism for ensuring that a first sheet is fed to a transfer roller at a proper time after applying ink to an image carrying plate such that the printing density of the first sheet is the same as that of subsequent sheets.

It is another object of the present invention to provide an offset printing machine which eliminates the problem of wasted sheets due to insufficient initial ink application.

It is another object of the present invention to provide an offset printing machine comprising a ratchet and a pawl which is reciprocated to drive the ratchet from a reset position to an actuating position to activate a sheet feed means at a predetermined optimum length of time after applying ink to an image carrying plate.

It is another object of the present invention to provide a generally improved offset printing machine.

Other objects, together with the foregoing, are attained in the embodiment of the present invention described in the following description and illustrated in the accompanying drawings.

DESCRIPTION OF THE PREFERRED EMBODIMENT

While the improved printing machine of the present invention is susceptible of numerous physical embodiments, depending upon the environment and requirements of use, substantial numbers of the herein shown and described embodiment have been made, tasted and used, and all have performed in an eminently satisfactory manner.

Figure 1:
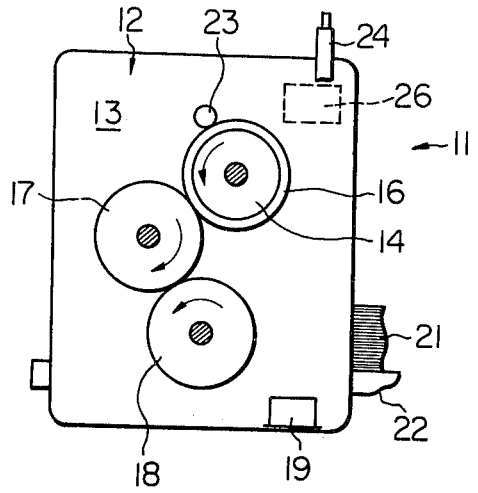
FIG. 1 is a plan view of an offset printing machine to which the present invention relates.

Referring now to FIG. 1 of the drawing, an offset printing machine is generally designated as 11 and comprises a frame 12 formed with opposite end plates 13, only one of which is visible. The end plates 13 rotatably support a plate roller or drum 14 adapted to support an image carrying plate 16, a transfer roller 17 and a pressure roller 18 which are rotatably driven as indicated by arrows in a synchronized manner by drive means which are not shown. A sheet fed unit 19 is arranged to sequentially feed sheets 21 from a table 22 between the rollers 17 and 18. An ink applicator roller 23 is arranged to apply ink to the plate 16, and the ink image is transferred from the plate 16 to the sheets 21 by the transfer roller 17 in a conventional manner. A control lever 24 is arranged to control the operation of the ink applicator roller 23 and transfer roller 17 as will be described in detail below, and is also arranged to control a mechanism 26 of the present invention which in turn controls the sheet feed unit 19.

Figure 2:
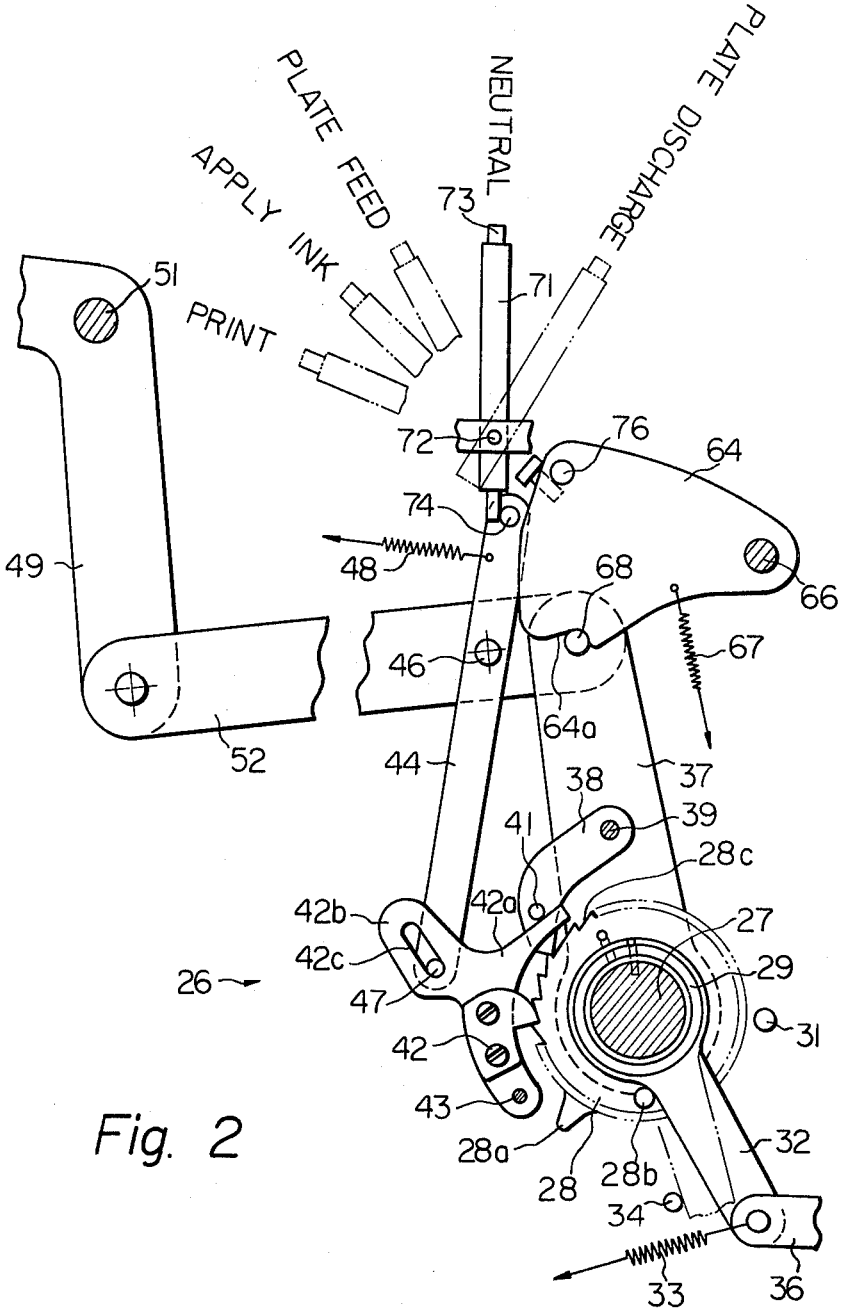
FIG. 2 is a partial plan view of an improved mechanism of the offset printing machine in a neutral position.

Referring now to FIG. 2, the mechanism 26 comprises a shaft 27 which is fixedly supported by the end plates 13. A ratchet 28 is rotatably supported by the shaft 27 and is formed with a stopper member **28*a*, an actuating pin 28*b* and a tooth cutout 28*c* in such a manner that one tooth which would normally be provided at the tooth cutout 28*c* is omitted or removed. A torsion spring 29 is connected between the shaft 27 and the ratchet 28 urging the ratchet 28 clockwise to a reset position in which the stopper member 28*a* abuts against a fixed stopper pin 31**.

An actuating arm 32 is privotally supported by the shaft 27 and is urged clockwise by a tension spring 33 toward abutment with a fixed stopper pin 34, as shown in phantom line. The actuating arm 32 is pivotally connected to a control link 36 of the sheet feed unit 19 in such a manner that the sheet feed unit 19 is de-activated when the actuating arm 32 is in the phantom line position and activated when the actuating arm 32 is moved to a solid line position against the force of the spring 33.

A pawl arm 37 is pivotally supported by the shaft 27 and a drive pawl 38 is pivotally supported by the pawl arm 37 about a pin 39. A release pin 41 is provided on the drive pawl 38. A holding pawl 42 is pivotally supported about a pin 43 for engagement with the ratchet 28 to prevent clockwise rotation thereof. The holding pawl 42 is bifurcated, a right arm **42*a* being arranged for engagement with the pin 41 of the drive pawl 38 and a left arm 42*b* thereof being formed with a slot 42*c*. A reset lever 44 is pivotally supported about a pin 46 and is provided with a pin 47 which engages in the slot 42*c* of the holding pawl 42. A tension spring 48 urges the reset arm 44 counterclockwise in such a manner that the pin 47 urges the holding pawl 42 into engagement with the ratchet 28**.

Figure 3:
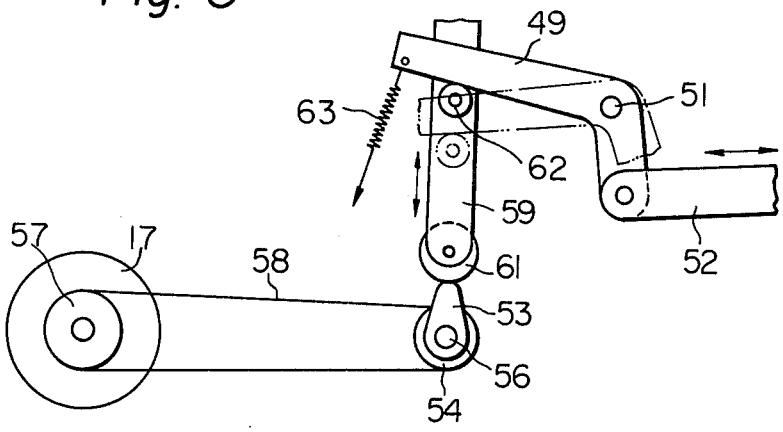
FIG. 3 is a paln view of a drive means for the mechanism of FIG. 2.

Referring also to FIG. 3, bellcrank lever 49 is pivotally supported about a pin 51 and is pivotally connected to the end of the pawl arm 37 by a connecting link 52. A cam 53 and a sprocket 54 are fixed to a rotary shaft 56 and are driven for rotation from the transfer drum 17 by means of a sprocket 57 integrally rotating with the transfer drum 17 and a chain 58 trained around the sprockets 54 and 57. A cam follower 59 carries a roller 61 at its lower end and a roller 62 above the roller 61. A tension spring 63 urges the bellcrank lever counterclockwise so that the left arm (not designated) of the bellcrank lever 49 engages at its lower edge with the roller 62 thereby urging the cam follower 59 downwardly and pressing the roller 61 into engagement with the cam 53. Rotation of the transfer drum 17 and cam 52 causes substantially vertical reciprocation of the cam follower 59 so that the roller 62 reciprocates between an upper solid line position and a lower phantom line position. This reciprocation of the cam follower 59 causes the bellcrank lever 49 to reciprocate between a solid line position and a phantom line position and furthermore causes the pawl arm 37 to pivotally reciprocate about the shaft 27 to an extent that each reciprocation thereof causes the drive pawl 38 to advance the ratchet 28 counterclockwise by one tooth.

A latch member 64 is pivotal about a pin 66 and urged counterclockwise by a tension spring 67 into engagement with a pin 68 which pivotally connects the pawl arm 37 to the connecting link 52. The latch member 64 is formed with a shoulder **64*a*. With the bellcrank lever 49 is moved to its solid line position in FIG. 3, the latch member 64 is moved to the position shown in FIG. 2 by the spring 67 so that the shoulder 64*a* is positioned to the right of the pin 68 thereby preventing rightward movement of the pin 68 and connecting link 52 and movement of the bellcrank lever 49 from the solid line position of FIG. 3 despite reciprocation of the cam follower 59 and roller 62**.

A tubular control lever 71 is pivotally supported about a shaft 72. A control rod 73 is slidably disposed inside the control lever 71 and is manually movable between an extended position in which the lower end thereof is retracted inside the control lever 71 and an extended position in which the lower end thereof extends below the control lever 71 as illustrated in FIG. 2. The control rod 73 is pushed into the control lever 71 to the extended position by the machine operator at the beginning of a printing operation and latches in the extended position until released as will be described in detail below.

Actuating pins 74 and 76 are fixed to the upper end of the reset lever 44 and to the upper left corner of the latch member 64 respectively to be engaged by the control rod 73.

Figure 4:
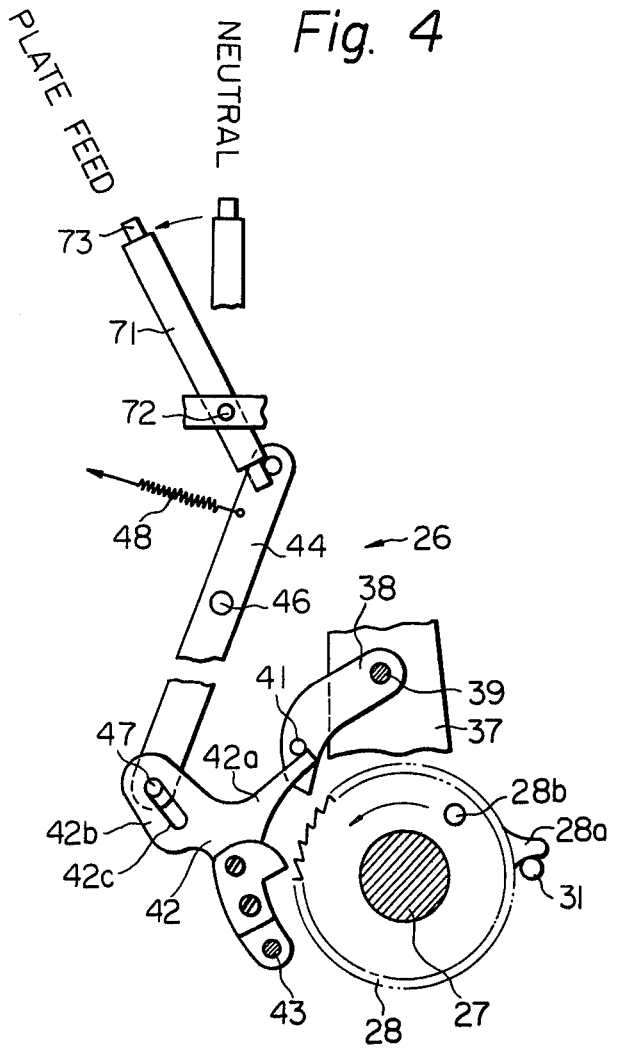
FIG. 4 is a partial view of the mechanism in a plate feed position.

The control lever 71 is movable between plate discharge, neutral, plate feed, apply ink and print positions as illustrated in FIG. 2. The latch member 64 is initially engaged with the pin 68 thereby latching the pawl arm 37 and preventing reciprocation of the drive pawl 38. To start a printing operation, the machine operator pushes the control rod 73 into the control lever 71 thereby latching the control rod 73 in the extended position with the lower end thereof protruding below the control lever 71 as illustrated in FIG. 2 and moves the control lever 71 to the plate feed position. The lower end of the control rol 73 engages with the pin 74 of the reset lever 44 thereby rotating the reset lever 44 clockwise against the force of the spring 48. As shown in FIG. 4, the pin 47 engages with the left end of the slot **42*c* in the arm 42*b* of the holding pawl 42 thereby pivoting the holding pawl 42 counterclockwise about the pin 43 out of engagement with the ratchet 28. The arm 42*a* of the holding pawl 42 engages with the pin 41 of the drive pawl 38 thereby pivoting the drive pawl 38 clockwise about the pin 39 out of engagement with the ratchet 28. The ratchet 28 is thereby released and is rotated clockwise by the spring 29 to the reset position in which the stopper member 28*a* abuts against the stopper pin 31. The actuating arm 32 is released by the actuating pin 28*b* and assumes the de-activated position in abutment with the pin 34, so that the sheet feed means 19 is de-activated. The control lever 71 is connected to a control mechanism (not shown) of the printing machine 11 in such a manner that movement thereof to the plate feed position causes a plate 16 to be fed into an operative mounted position on the drum 14**.

When the plate 16 is securely mounted on the drum 14 the operator moves the operating lever 71 to the apply ink position, thereby effecting inking of the plate 16. The protrusion of the control rod 73 from the control lever 71 is selected such that when the control lever 71 is moved from the plate feed position to the apply ink position the lower end of the control rod 73 clears the pin 74 thereby releasing the reset lever 44 and allowing the pawls 38 and 42 to re-engage with the ratchet 28. In the apply ink position, the lower end of the control rod 73 assumes a position such that it is just about to engage with the pin 76 of the latch member 64 as shown in phantom line in FIG. 2. The latch member 64 remains in the position of FIG. 2 with the shoulder **64*a* engaged with the pin 68 to prevent movement of the pawl arm 37**.

When the control lever 71 is moved to the print position the transfer roller 17 is coupled to the plate 16 so that the ink image is transferred thereto for ultimate transfer to the sheets 21. If the sheet feed were initiated at this time, the ink buildup on the transfer roller 17 would be insufficient to provide satisfactory printing of the first sheet 21. However, the mechanism 26 provides a predetermined optimum time delay before activating the sheet feed unit 19 so that the density of the first sheet 21 and all subsequent sheets 21 are the same.

Figure 5:
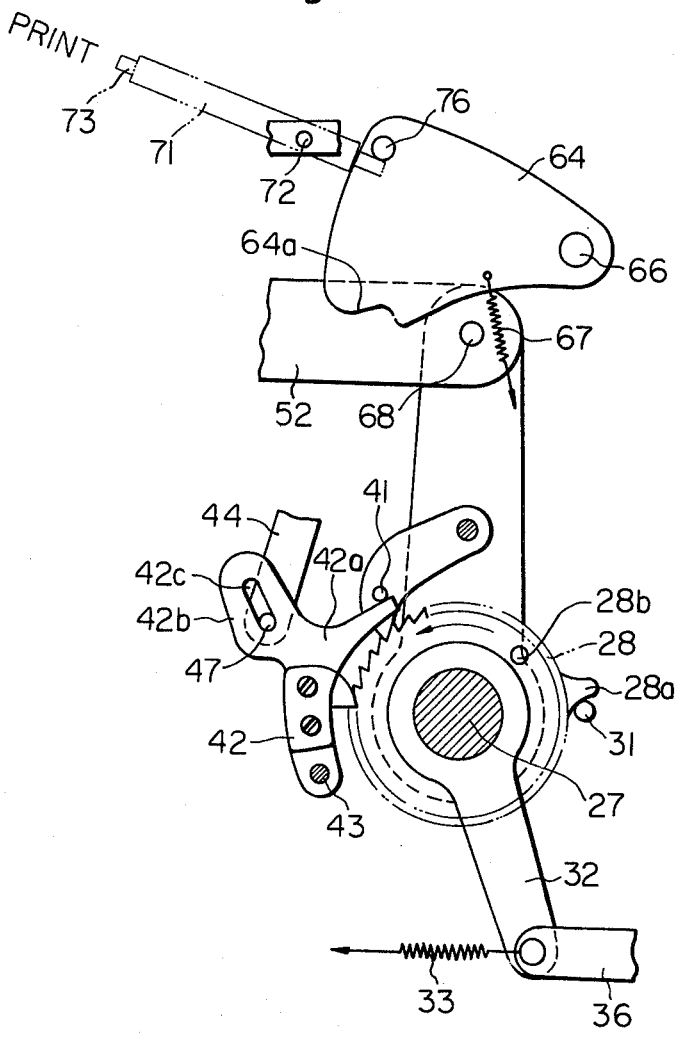
FIG. 5 is a partial plan view of the mechanism in a printing position.

When the control lever 71 is moved to the print position the lower end of the control rod 73 engages with the pin 76 thereby rotating the latch member 64 clockwise against the force of the spring 67. The shoulder **64*a* moves upwardly out of engagement with the pin 68 thereby releasing the pawl arm 37 and the bellcrank lever 49 as shown in FIG. 5. The bellcrank lever 49 and pawl lever 37 are reciprocated by the cam follower 59 so that the ratchet 28** is advanced one tooth at a time in the counterclockwise direction from the reset position.

The drive pawl 38 and holding pawl 42 act in combination to effect advancement of the ratchet 28. The drive pawl 38 advances the ratchet 28 by one tooth with each counterclockwise movement thereof and the holding pawl 42 prevents the ratchet 28 from rotating clockwise with the drive pawl 38 as the drive pawl 38 moves clockwise to engage with the next tooth of the ratchet 28.

As the ratchet 28 reaches an actuating position shown in FIG. 2, the pin **28*b* engages with the actuating arm 32 thereby pivoting the actuating arm 32 counterclockwise from the de-activated position to the activating position shown in FIG. 2 in solid line to activate the sheet feed unit 19 and initiate sheet feed. As a result, the first sheet 21 is fed to the transfer roller 17** at the optimum time.

In the activating position of the ratchet 28 shown in FIG. 2, the tooth cutout **28*c* aligns with the drive pawl 38 so that further advancement of the ratchet 28 by the drive pawl 38 is prevented. Although the drive pawl 38 continues to reciprocate, the next tooth of the ratchet 28 with which it would engage, at the position of tooth cutout 28***c*, is missing, and the drive pawl 38 cannot therefore drive the ratchet 28.

After the printing operation is completed, the control rod 73 is retracted into the control lever 71 either manually or automatically and the control lever 71 is rotated to the plate discharge position in which the plate 16 is removed from the drum 14. After this operation is completed, the operating lever 71 is moved to the neutral position in preparation for another printing operation.

When the control rod 73 is retracted into the control lever 7 with the control lever 71 in the print position, the pin 76 and thereby the latch member 64 are released so that the shoulder 64*a* of the latch member 64 engages with the pin 68 to latch the pawl 37 the next time the bellcrank lever 49 reaches the solid line position in FIG. 3. In this manner, the mechanism 26 is returned to its original status.

It will be noted that the number of reciprocations of the pawl arm 37 to move the ratchet 28 from the reset position to the actuating position is determined by the circumferential spacing of the stopper member 28*a* relative to the pin 28*b* and tooth cutout 28*c*. Since the pawl arm 37 is driven in synchronism with the transfer roller 17 and the length of time for each reciprocation of the pawl arm 37 is known, the time delay provided by the mechanism 26 corresponds to the length of time for the ratchet 28 to move from the reset position to the actuating position. The time delay may be set to any desired optimum value through selection of the positions of the stopper member 28*a*, pin 28*b* and tooth cutout 28*c*.

It will be seen that the present invention provides, in a unique adaptation of a ratchet and pawl mechanism, a precision time delay function for an offset printing machine so that the first sheet is fed to the transfer roller at the optimum time after ink has begun to be transferred to the transfer roller so that the problem of wasted first sheets is positively prevented. Many modifications within the scope of the invention will become possible for those skilled in the art after receiving the teachings of the present disclosure. For exambple, the control lever 71 may be operated automatically by a sequencing motor or the like rather than manually.

What is claimed is:

1. In a printing machine including a printing means, a sheet feed means for feeding sheets to the printing means for printing and a control member movable between a neutral position for de-activating the printing means and sheet feed means and a print position for activating the printing means, an improvement for activating the sheet feed means after a predetermined length of time after the control member is moved from the neutral position to the print position, said improvement comprising the combination of:

a ratchet formed with an actuating member, the ratchet being rotatable between a reset position in which the actuating member is disengaged from the sheet feed means thereby de-activating the sheet feed means and an actuating position in which the actuating member engages with the sheet feed means thereby activating the sheet feed means;

a drive pawl arranged to be reciprocatingly driven to engage with and advance the ratchet from the reset position to the actuating position in a predetermined number of reciprocations thereof corresponding to the predetermined length of time;

drive means for reciprocatingly driving the drive pawl;

a holding pawl for engaging with and thereby preventing rotation of the ratchet from the actuating position to the reset position;

reset means actuated by the control member to move the drive pawl and the holding pawl out of engagement with the ratchet thereby allowing the ratchet to move to the reset position when the control member is moved from the neutral position to an intermediate position between the neutral position and the print position, the reset means moving the drive pawl and the holding pawl into engagement with the ratchet when the control member is moved from the intermediate position to the print position; and latch means actuated by the control member for disconnecting the drive means from the drive pawl when the control member is in the neutral position and connecting the drive means to the drive pawl when the control member is moved from the neutral position to the print position, the latch means continuing to disconnect the drive means from the drive pawl when the control member is in the intermediate position.

2. A printing machine as in claim 1, in which the latch means comprises a latch member biased in one direction to engage the drive means and thereby prevent movement of the drive pawl, the control member being arranged to move the latch member in an opposite direction to disengage the drive means and thereby release the drive pawl when the control member is in the print position.

3. A printing machine as in claim 2, wherein the drive means comprises a pawl arm means on which the driving pawl is pivotably mounted, the latch member being biased in said one direction to engage the pawl arm means to prevent movement of the latter, the control arm being operable to move the latch member in an opposite direction to a position out of engagement with the pivotal arm means.

4. A printing machine as in claim 1, wherein the control arm is pivotal about a fixed axis, the reset means and the latch means having actuating parts disposed within the path of pivotable movement of the control arm.

5. A printing machine as in claim 1, wherein the holding pawl is pivotably mounted, the reset means comprising a pivotably mounted reset arm, and a pin and slot means interposed between the reset arm and the holding pawl, whereby pivotal movement of the reset arm about its pivotal axis by the control arm effects pivotal movement of the holding pawl about its pivotal axis.

6. A printing machine as in claim 5, wherein the holding pawl has an arm engageable with the driving pawl to move the driving pawl out of engagement with the ratchet when the holding pawl is moved out of engagement with the ratchet.

7. A printing machine as in claim 1, in which the ratchet is formed with a tooth cutout spaced in such a manner that the drive pawl engages with the tooth cutout when the ratchet is in the actuating position so that driving engagement of the drive pawl with the ratchet is terminated when the ratchet reaches the actuating position.

8. A printing machine as in claim 1, in which the ratchet is formed with a stop member, said improvement further comprising a stopper with which the stop member of the ratchet abuttingly engages in the reset position.

* * * * *